US007405398B2

(12) United States Patent
Jolliffe et al.

(10) Patent No.: US 7,405,398 B2
(45) Date of Patent: Jul. 29, 2008

(54) MASS SPECTROMETER INTERFACE

(75) Inventors: Charles Jolliffe, Schomberg (CA); Gholamreza Javahery, Kettleby (CA); Lisa Cousins, Woodbridge (CA)

(73) Assignee: IONICS Mass Spectrometry Group, Inc., Concord, Ontario (CA)

( * ) Notice: Subject to any disclaimer, the term of this patent is extended or adjusted under 35 U.S.C. 154(b) by 0 days.

(21) Appl. No.: 11/406,462

(22) Filed: Apr. 18, 2006

(65) Prior Publication Data

US 2006/0186334 A1 Aug. 24, 2006

Related U.S. Application Data

(63) Continuation of application No. 10/864,106, filed on Jun. 9, 2004, now Pat. No. 7,091,477.

(60) Provisional application No. 60/476,631, filed on Jun. 9, 2003.

(51) Int. Cl.
*H01J 49/00* (2006.01)

(52) U.S. Cl. ..... 250/288; 250/284; 250/286; 250/287; 250/281

(58) Field of Classification Search ..... 250/288, 250/284, 286–287
See application file for complete search history.

(56) References Cited

U.S. PATENT DOCUMENTS

| | | | | |
|---|---|---|---|---|
| 4,023,398 A | | 5/1977 | French et al. | 73/23 |
| 4,531,056 A | | 7/1985 | Labowsky et al. | 250/288 |
| 4,842,701 A | | 6/1989 | Smith et al. | 204/180.1 |
| 4,861,988 A | | 8/1989 | Henion et al. | 290/288 |
| 4,885,076 A | | 12/1989 | Smith et al. | 204/299 R |
| 4,948,962 A | * | 8/1990 | Mitsui et al. | 250/288 |
| 4,977,320 A | | 12/1990 | Chowdhury et al. | 250/288 |
| 4,990,740 A | * | 2/1991 | Meyer | 219/121.52 |

(Continued)

FOREIGN PATENT DOCUMENTS

| | | |
|---|---|---|
| GB | 2 324 906 | 4/1998 |

(Continued)

OTHER PUBLICATIONS

R.A. Zubarev, et al., "Electron Capture Disassociation of Multiply Charged Protein Cations. A Nonergodic Process", *J. Am. Chem. Soc.*, 120, 3265-3266 (1998).

(Continued)

*Primary Examiner*—Jack I. Berman
*Assistant Examiner*—Michael J Logie
(74) *Attorney, Agent, or Firm*—Woodard, Emhardt, Moriarty, McNett & Henry, LLP Patent and Trademark Attorneys

(57) ABSTRACT

A mass spectrometer interface, having improved sensitivity and reduced chemical background, is disclosed. The mass spectrometer interface provides improved desolvation, chemical selectivity and ion transport. A flow of partially solvated ions is transported along a tortuous path into a region of disturbance of flow, where ions and neutral molecules collide and mix. Thermal energy is applied to the region of disturbance to promote liberation of at least some of the ionized particles from any attached impurities, thereby increasing the concentration of the ionized particles having the characteristic m/z ratios in the flow. Molecular reactions and low pressure ionization methods can also be performed for selective removal or enhancement of particular ions.

21 Claims, 7 Drawing Sheets

U.S. PATENT DOCUMENTS

| | | | | |
|---|---|---|---|---|
| 5,015,845 | A | 5/1991 | Allen et al. | 250/288 |
| 5,070,240 | A * | 12/1991 | Lee et al. | 250/288 |
| 5,103,093 | A | 4/1992 | Sakairi et al. | 250/288 |
| 5,171,990 | A | 12/1992 | Mylchreest et al. | 250/288 |
| 5,229,605 | A * | 7/1993 | Bridenne et al. | 250/282 |
| 5,313,061 | A | 5/1994 | Drew et al. | 250/281 |
| 5,352,892 | A | 10/1994 | Mordehai et al. | 250/288 |
| 5,412,208 | A * | 5/1995 | Covey et al. | 250/288 |
| 5,454,274 | A * | 10/1995 | Zhu | 73/863.12 |
| 5,756,994 | A | 5/1998 | Bajic | 250/288 |
| 6,124,675 | A | 9/2000 | Bertrand et al. | 315/111.91 |
| 6,252,225 | B1 * | 6/2001 | Takada et al. | 250/288 |
| 6,265,717 | B1 * | 7/2001 | Sakata et al. | 250/289 |
| 6,462,336 | B1 | 10/2002 | Bajic | 250/288 |
| 6,700,119 | B1 | 3/2004 | Giles | 250/288 |
| 6,781,117 | B1 * | 8/2004 | Willoughby et al. | 250/281 |
| 7,098,452 | B2 * | 8/2006 | Schneider et al. | 250/288 |
| 2002/0003210 | A1 * | 1/2002 | Marcus | 250/288 |
| 2003/0062474 | A1 * | 4/2003 | Baranov et al. | 250/288 |
| 2004/0262512 | A1 * | 12/2004 | Tobita et al. | 250/288 |
| 2006/0118715 | A1 * | 6/2006 | Schneider et al. | 250/290 |

FOREIGN PATENT DOCUMENTS

GB 2324906 A * 11/1998

OTHER PUBLICATIONS

Edgar D. Lee, et al., "Thermally Assisted Electrospray Interface for Liquid Chromatograph/ Mass Spectrometry", *Rapid Communication in Mass Spectrometry*, vol. 6, 727-733 (1992).

William J. Herron et al., "Reactions of Polyatomic Dianions with Cations in the Paul Trap", Chemical and Analysis Sciences Division, Oak Ridge National Laboratory, Oak Ridge, TN 37831, 5 pgs. (1995).

* cited by examiner

MASS SPECTROMETER INTERFACE

CROSS-REFERENCES TO RELATED APPLICATIONS

This application is a continuation of U.S. application Ser. No. 10/864,106, entitled "MASS SPECTROMETER INTERFACE," filed Jun. 9, 2004 now U.S. Pat. No. 7,091,477 which is hereby incorporated by reference in its entirety and which claims the benefit of U.S. Provisional Patent Application No. 60/476,631 filed on Jun. 9, 2003, which is hereby incorporated by reference in its entirety.

FIELD OF THE INVENTION

The present invention relates generally to mass spectrometry and more particularly to an interface for providing particles to a mass spectrometer, and to a mass spectrometry apparatus including the interface, and related methods.

BACKGROUND OF THE INVENTION

Mass spectrometry (MS) is a well-known technique of obtaining a molecular weight and structural information about chemical compounds. Using mass spectrometry techniques, molecules may be weighed by ionizing the molecules and measuring the response of their trajectories in a vacuum to electric and magnetic fields. Ions are weighed according to their mass-to-charge (m/z) values.

Atmospheric pressure ion sources (API) have become increasingly important as a means for generating ions used in mass spectrometers. Some common atmospheric pressure ion sources include Electrospray or nebulization assisted Electrospray (ES), Atmospheric Pressure Chemical Ionization (APCI), Atmospheric Photo Ionization (APPI), and Matrix Assisted Laser Desorption Ionization (MALDI). These ion sources produce charged particles, such as protonated molecular ions or adduct, from analyte species in solution or solid form, in a region which is approximately at atmospheric pressure.

API sources are advantageous because they provide a gentle means for charging molecules without inducing fragmentation. They also provide ease of use because samples can be introduced at atmosphere.

Mass spectrometers, however, generally operate in a vacuum maintained between $10^{-4}$ to $10^{-10}$ Torr depending on the mass analyzer type. Thus once created, the charged particles must be transported into vacuum for mass analysis. Typically, a portion of the ions created in the API sources are entrained in a bath gas API source chamber and swept into vacuum along with a carrier gas through an orifice into vacuum. Doing this efficiently presents numerous challenges.

Disadvantageously, API sources produce high chemical background and relatively low sensitivity. This results in a poor signal-to-noise ratio. This is believed to be caused by sampling of impurites attached to analyte ions (for example, cluster molecules, atoms or ions, or other undesired adducts), caused by incomplete desolvation during the API process. Many solvated droplets enter into the mass spectrometer and consequently produce a large level of chemical noise across the entire mass range. Additionally incompletely vaporized droplets linger near the sampling orifice.

These problems can be most severe for high flow rates. Efficient Electrospray Ionization (ESI) at high liquid flow rates requires sufficient energy transfer for desolvation and a method to deter large clusters from entering the vacuum chamber while enhancing the ion capture. High flow rate analyses are important to industries that have large throughput requirements (such as drug development today, and in the future, protein analysis). For most modern applications of ESI and APCI, liquid samples are passed through the source at high flow rates.

Another problem with electrospray concerns the condensation of the expanding jet and clustering of the ions. Various instrument manufactures use a conventional molecular beam interface to couple an ion source to the low pressure vacuum region. Conventionally, a molecular free jet is formed as gas expands from atmosphere into an evacuated region. The ion flux is proportional to the neutral density in a free jet, which depends on the shape and size of the orifice through which the gas expands, as well as the pressure of the evacuated region. In conventional ion sources, a skimmer samples the free jet, and the ions are detected downstream. This approach has several negative side effects, including: a) restricting the time for ion desolvation, b) enhancing ion salvation, c) restricting the gas flow through the orifice due to pumping requirements and the spatial requirements of sampling a free jet expansion.

To reduce the problem of incomplete desolvation, heated gases are commonly employed to vaporize with a flow direction opposite, or counter, to sprayed droplets in order to desolvate ions at atmospheric pressure. Since the heated gases remove some of the solvent vapor from the stream of gas before being drawn into the vacuum chamber, this technique may partially assist to increase the concentration of ions of interest entering the vacuum chamber.

While the counter flow of gas results in some improvement in sensitivity for low liquid flow rates, it is insufficient for high liquid flow rates, for example 10 microliters per minute or more, where substantially more energy transfer is required than the counter flow of gas can provide. Also, even for low liquid flow rates, it substantially increases the complexity of the interface between the electrospray and the mass spectrometer. In order that the solvent vapor from the evaporating droplets be efficiently removed by the counter flowing gas, both the temperature and the flow rate of the gas must be carefully controlled. High gas flow rates may prevent some ions with low mobility from entering the analyzer, while low gas flow rates or reduced gas temperature may not sufficiently desolvate the ions. The counter flowing gas flow rate and temperature are typically optimized for each analyte and solvent. Accordingly, much trial and error time is necessary to determine the optimum gas flow rate and temperature for each particular analyte utilizing a particular electrospray device and a particular mass spectrometer. As a result only a small fraction of the produced ions are focused by the lenses and transmitted to the mass analyzer for detection. Accordingly, this reduced transfer of ions to the mass analyzer produced by electrospray substantially limits the sensitivity and the signal-to-noise ratio of the electrospray/mass spectrometer technique.

Alternatively, an additional heated desolvation chamber located downstream of the first nozzle of a conventional molecular beam interface may be used. The electrosprayed droplets first expand in a supersonic expansion and then are passed into a second heated chamber pumped by a separate pumping system, which is maintained at a pressure preferably less than 1 Torr. This beam is then passed on-axis into a mass spectrometer. This design suffers from incomplete desolvation due to low residence time in the chamber, and compromises sensitivity due to scattering losses. Also the molecular beam is sampled on-axis with respect to the gas in the heated chamber, and therefore still permits incompletely de-solvated ions to enter the mass spectrometer. This design yields increased complexity and cost of an additional pumping stage following the initial expansion.

It is therefore desirable to provide an improved mass spectrometer interface for atmospheric pressure ionization sources.

BRIEF SUMMARY OF THE INVENTION

Accordingly, in an aspect of the present invention, there is provided a method of supplying ionized particles (having characteristic mass to charge (m/z) ratios) of a sample to a mass spectrometer. The method includes providing a tortuous flow of gas having at least one region of disturbance, to transport the ionized particles. A first mixture of the ionized particles and any attached impurities is introduced into the flow to allow the ionized particles to collide in the region of disturbance. Thermal energy is added proximate the region of disturbance to promote liberation of at least some of the ionized particles from the impurities, thereby increasing the concentration of the ionized particles having the characteristic m/z ratios in the flow.

In an embodiment, a channel guides the gas around a barrier positioned in the flow. The barrier deflects at least part of the flow to form the region of disturbance.

In an example embodiment, the channel guides the gas around a bend having an angle of at least 20 degrees.

The method may further include colliding the ionized particles and attached impurities, with a wall of the channel, so as to promote liberation of at least some of the ionized particles from the impurities.

The method may further optionally include introducing a solid sample in the region of disturbance, and forming the ionized particles and any attached impurities from the solid sample using one or more of matrix assisted laser desorption ionization (MALDI), photo-ionization, and corona discharge ionization.

The ionized particles and any attached impurities may alternatively be formed using one or more of electrospray ionization (ESI), matrix-assisted laser desorption ionization (MALDI), atmospheric pressure chemical ionization (APCI), and atmospheric pressure photoionization (APPI).

In another aspect of the present invention, an apparatus for providing ionized particles (having characteristic mass to charge (m/z) ratios) of a target sample to a mass spectrometer includes a channel for guiding a flow of gas along a tortuous path creating at least one region of disturbance in the flow, the region of disturbance for colliding a mixture of ionized particles and any attached impurities to liberate at least some of the ionized particles from the impurities, thereby increasing the concentration of the ionized particles having the characteristic m/z ratios in said flow.

Advantageously, embodiments of the invention provide a high signal-to-noise ratio, with increased sensitivity and reduced chemical background, particularly using high liquid flow rates, by improving the efficiency of liberating attached impurities such as cluster molecules, atoms, ions or adducts.

DETAILED DESCRIPTION OF THE INVENTION

Figure 1:
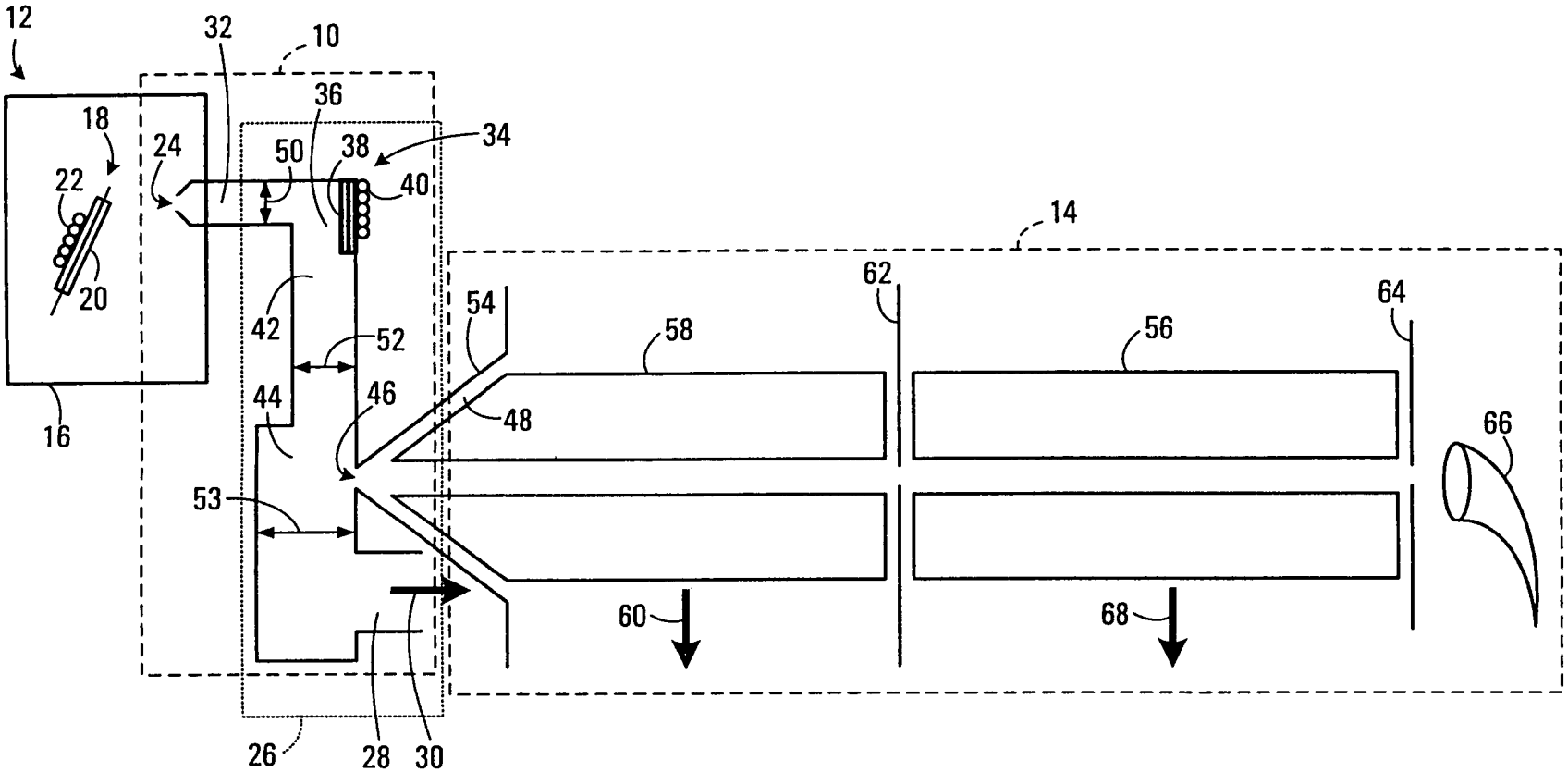
FIG. 1 is a sectional view of an exemplary embodiment of a mass spectrometer interface utilizing an electrospray source and a mass spectrometer.

An exemplary embodiment of a mass spectrometer interface 10 is illustrated in FIG. 1. As illustrated, mass spectrometer interface 10 couples an atmospheric pressure ion source 12 and a mass spectrometer 14 in such a way as to enhance concentration, or sensitivity, of ions of characteristic m/z and reduce chemical background while providing the appropriate gas flow to a mass spectrometer system.

Atmospheric pressure ion source 12 is enclosed in a chamber 16 that is maintained at approximately atmospheric pressure. In the exemplary embodiment, ion source 12 is shown as electrospray, but may be an ion spray, a MALDI, a corona discharge device, an atmospheric pressure chemical ionization device, an atmospheric pressure photo ionization device, or any other known ion source.

A trace substance to be analyzed is ionized by electrospray ionization using a needle 18 or other ionizing means, in a conventional manner. Samples injected into ion source 12 elute in a flow of liquid that typically may be in the range of from 0.5 to more than 10000 microliters per minute. Alternatively, nanospray techniques may be used to improve the flow at lower flow rates. The liquid composition may vary from essentially pure water to essentially pure organic solvent, such as methanol, and both solvent components may contain additives such as organic acids or inorganic buffers. Heated nebulizing gas can be applied through tube 20 heated by element 22 to aid in the dispersion and evaporation of the electrospray droplets.

Interface 10 transports ions from source 12 to mass spectrometer 14. Specifically, ions and neutral gas molecules are transported from high-pressure chamber 16 through first sampling orifice 24, into a lower pressure region 26. Exemplary orifice 24 is 350 microns diameter although other diameters are suitable for alternative configurations. Ions and neutral gas expand into a moderate pressure region of channel 32 where, after several orifice diameters, they are believed to experience shock structures followed by rapid pressure gradients within a sampling tube. Eventually the flow becomes generally laminar. Thus the ions and neutral flow are first entrained in a relatively high velocity neutral flow through sampling channel 32. Exemplary interface 10 body is evacuated through evacuation port 28 by a roughing pump 30, pumping 10 l/s holding the average pressure in the range of 2 Torr.

Sampling channel 32 provides a tortuous path for the gas and ions and may be formed of a conductive tube, a semi-conductive or non-conducting capillary, with a straight geometry, smoothly bent geometry or radius R, a tube with one or more smooth bends, or a tube with one or more sharp bends. Channel 32 is typically a 4-10 mm bore diameter. Exemplary channel 32 of FIG. 1 is 6 mm and includes a bend 34 preferably greater than 20 degrees, positioned downstream of orifice 24, causing a disturbance in the flow of the transported ions and gas, characterized for example by turbulence, mixing, increase in collision frequency, or otherwise randomization of flow velocity of the gas and ions, in region 36. A body 38 positioned near bend 34, may be heated by elements 40. Alternatively, the tube itself may consist of heated material.

In any event, ions and neutrals undergo gas-surface and gas-gas interactions in region 36 to liberate at least some of the ionized molecules from attached impurities, such as neutral molecules, radicals, adducts, and other ions. This increases the concentration of desired ionized molecules with characteristic m/z ratios in the flow and reduces impurities that generate chemical background. The ion and neutral gas continue a flow through tubes 42 and 44, with a diameter of typically 5-15 and 10-30 mm bore, respectively. Again eventually the flow becomes generally laminar, typically after the flow has traveled twice the diameter of the tube following the region of disturbance. In exemplary interface 10 the pressure in tube 44 from which ions are sampled from the laminar flow is approximately 2 Torr.

The ion and neutral gas flow is sampled perpendicular to the flow through a second sampling orifice 46 of skimmer body 54. Exemplary sampling orifice 46 is 5 mm diameter. Sampled ions and neutrals are then transported from the laminar flow region through lower pressure region 48 into mass spectrometer 14.

Unsampled ions and neutral flow are evacuated through evacuation port 28 advantageously positioned alongside and downstream the second sampling orifice 46. The position of evacuation port 10 provides angular momentum to the flow that is believed to improve perpendicular sampling efficiency through orifice 46.

In the embodiment of FIG. 1, diameter 52 of flow tube 42 is greater than diameter 50 of flow channel 32, and similarly diameter 53 of flow tube 44 is greater than diameter 52 of flow tube 42. By way of example, for diameters of 5 mm, 10 mm, and 20 mm, respectively, the speed of flow through the channel 12 may be in the order of approximately 400 m/s, the speed of flow through tube 17 may be in the order of approximately 100 m/s, and the speed of flow through tube 18 may be in the order of approximately 30 m/s.

Thus, with progressively larger cross-sections/diameters in the channel sections, 32, 42, 44, the ion and neutral flow velocity is continually decreased along the flow. The reduced flow velocity extends the transit time prior to sampling, enhancing the desolvation efficiency and therefore signal-to-noise ratio. The reduced velocity of the flow appears to substantially enhance the sampling efficiency near second sampling orifice 46.

If an even slower velocity is desired, the flow tubes 42 and 44 may have an even larger diameter of up to 15 mm and 30 mm bore, respectively.

Optionally, a small voltage gradient may be applied across interface 10 and skimmer body 54 aiding in the deflection of ions into mass spectrometer 14.

Mass spectrometer 14 may be a conventional mass spectrometer, including but not limited to quadrupole mass analyzers, magnetic sectors, hybrid and stand-alone time-of-flight devices, 2- and 3-dimensional ion traps, and Fourier transform mass spectrometers.

In the embodiment of FIG. 1, a quadrupole mass analyzer 56 suitable for analysis of liquid chromatograph is depicted. Accordingly, analyzer 56 may receive a beam of ions centrally passing first between multiple charged rods 58 of any multipole ion guide which create an RF electrical field within the analyzer. Rods 58 are typically held in a moderate pressure region of $10^{-4}$ to $10^{-2}$ Torr, and are evacuated by vacuum pump port 60. Ions are radially focused and transmitted through aperture 62 to quadrupole mass analyzer 56 that creates a DC and RF electrical field. According to their mass-to-charge ratio, the ions are either deflected or transmitted by the electrical field, and the transmitted ions may be detected by a standard electron multiplier detector 66 with aperture 64 to shield analyzer 56 from electric fields of multiplier detector 66. The electric field which deflects the ions is maintained at a vacuum of less than about $10^{-5}$ Torr by evacuation port 68.

Various alternative configurations of mass spectrometer interface are illustrated in FIGS. 2A-2G.

Figure 2C:
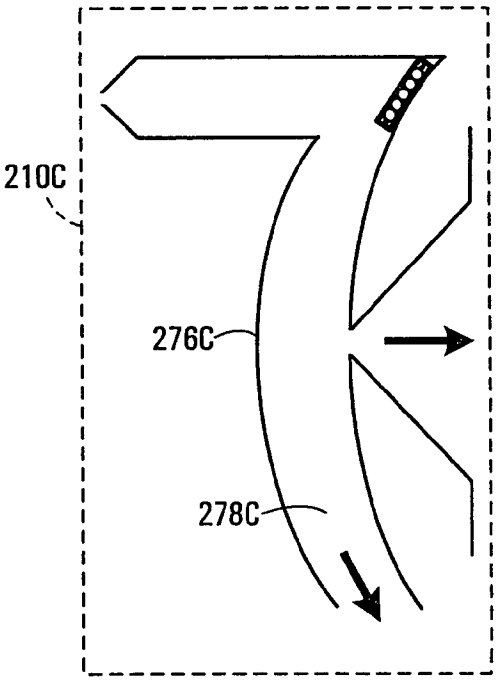
FIG. 2C is a sectional view of yet another exemplary mass spectrometer interface utilizing a curved flow tube.
Figure 2B:
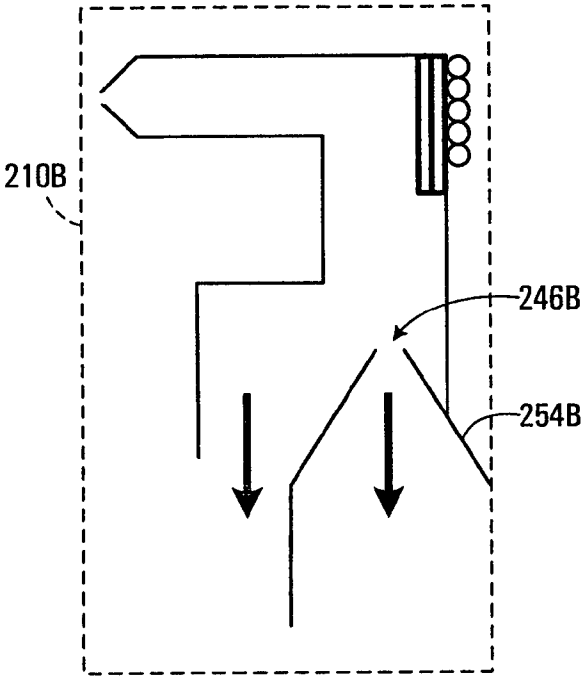
FIG. 2B is a sectional view of another exemplary mass spectrometer interface utilizing an on-axis sampling region.
Figure 2A:
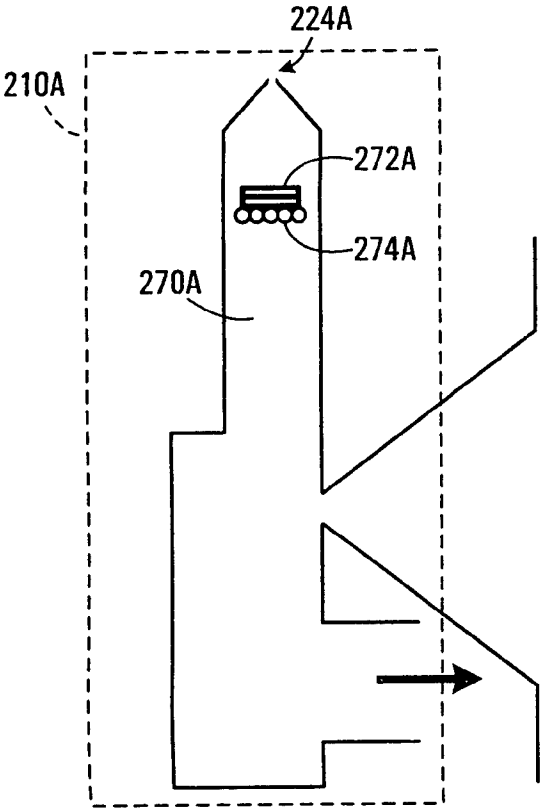
FIG. 2A is a sectional view of another exemplary mass spectrometer interface utilizing a straight bore tube and a heated barrier to create a region of disturbance.

As illustrated in FIG. 2A, for example, an interface 210A to transport ions and neutral gas includes sampling orifice 224A leading into a channel defined by straight tube 270A equipped with barrier 272A and heater 274A. Barrier 272A creates a tortuous path within the channel.

FIG. 2B depicts an alternative geometry whereby skimmer body 254B is positioned ions along the direction allowing ions of mass spectrometer interface 210B to be sampled through orifice 246B along the direction of the flow.

FIG. 2C depicts yet another alternative configuration for mass spectrometer interface 210C where tube 276C is smoothly varying in radius to permit control of the gas flow through port 278C. This configuration likely enhances sampling efficiency by controlling the angular momentum of the gas flow.

Figure 2E:
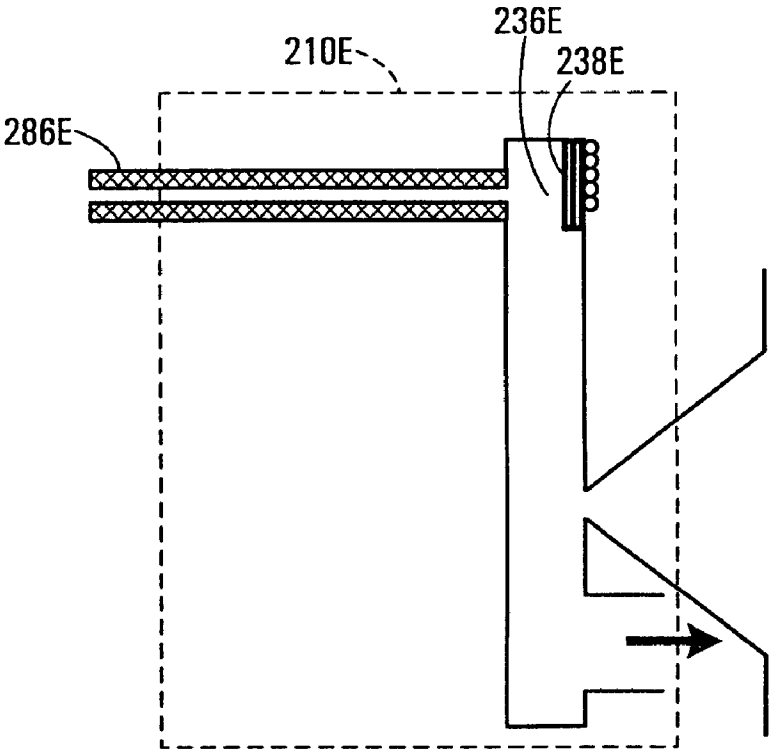
FIG. 2E is a sectional view of a further exemplary mass spectrometer interface utilizing a narrow bore capillary as the sampling channel.
Figure 2D:
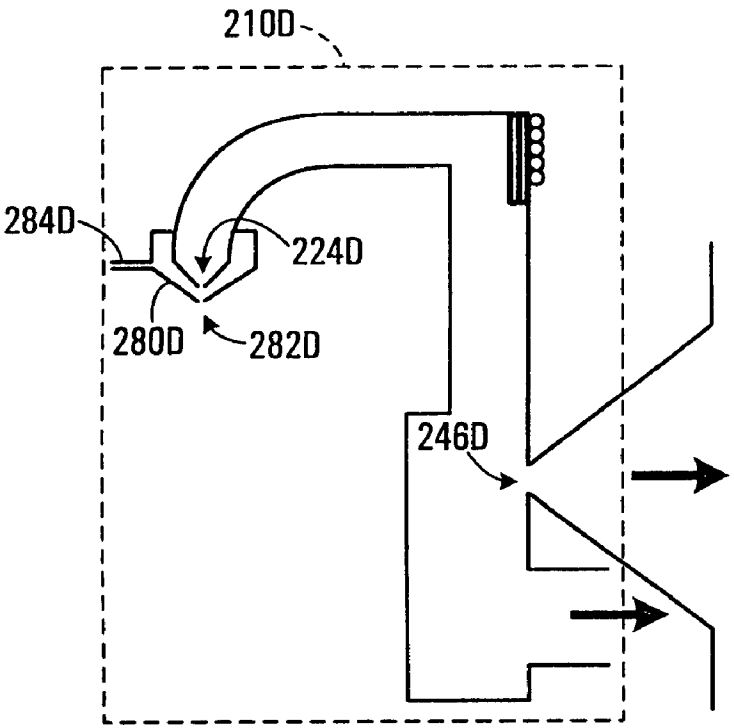
FIG. 2D is a sectional view of another exemplary mass spectrometer interface to which counter-current gas flow is applied and ion deflectors are used to bend ions toward the mass spectrometer inlet.

FIG. 2D illustrates a further alternative configuration, in which mass spectrometer interface 210D includes an additional curtain gas chamber region 280D with orifice 282D through which sheath flow gas is passed to aid in desolvation and prevention of background gas from streaming toward first sampling orifice 224D. An inert curtain gas, such as nitrogen, argon or carbon dioxide, is supplied via a gas source 284D to the curtain gas chamber region 280D. (Dry air can also be used in some cases.) The curtain gas flows through orifice 282D primarily in a direction away from mass spectrometer interface 1 to prevent air and contaminants in such chamber from entering the vacuum system.

FIG. 2E illustrates the use of a narrow bore capillary 286E in place of a larger bore sampling channel in mass spectrometer interface 210E. The narrow bore capillary 286E provides a high velocity flow of gas exiting into region 236E further creating disturbance near surface 238E.

Various electrode configurations may be used to aid in the ion transport through the mass spectrometer interface 10 of FIG. 1 (or 210A-210E of FIGS. 2A-2E). For example, as illustrated in mass spectrometer interface 210F of FIG. 2F, one or more electrodes 290F and 292F, to which a voltage is applied, can be inserted into body 297F through insulators 296F and 298F may be used to deflect ions towards second sampling orifice 246F. This can serve to increase the ion-togas ratio through second sampling orifice 246F and further enhance the signal-to-background ratio of the mass spectrometer.

Figure 2G:
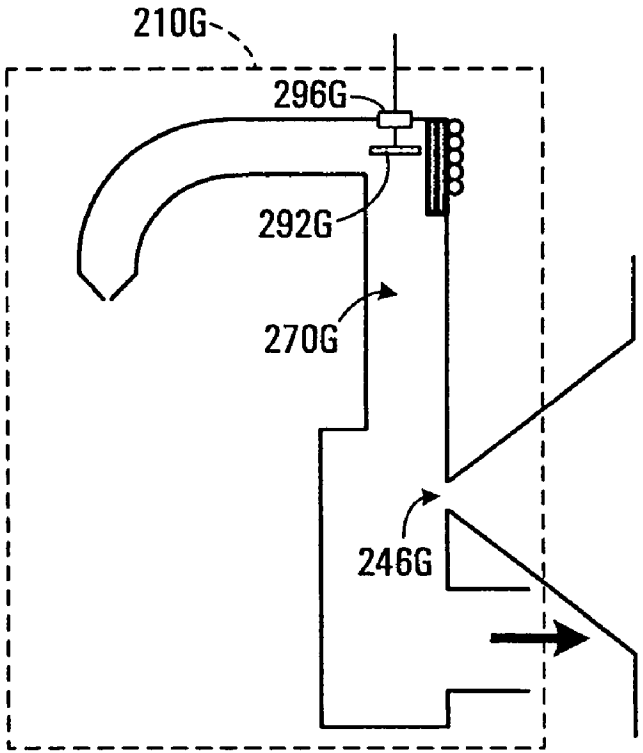
FIG. 2G is a sectional view of a mass spectrometer interface for which an ion deflector is used to pulse a range of ions through the tube.
Figure 2F:
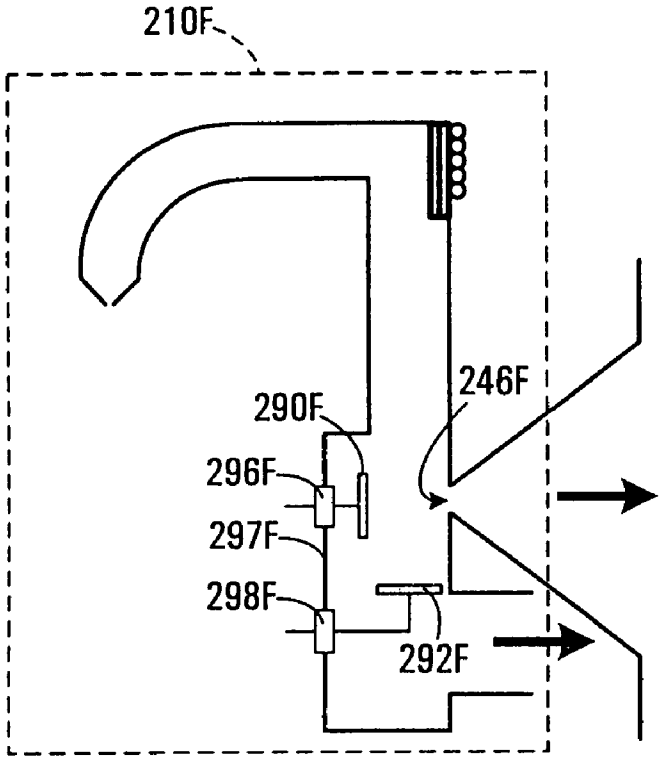
FIG. 2F is a sectional view of a mass spectrometer interface in which ion deflectors are used to bend ions toward the mass spectrometer inlet.

Yet another alternative electrode configuration is illustrated in mass spectrometer interface 210G of FIG. 2G. Here, an electrode 292G is positioned via insulator 296G upstream of the sampling orifice 246G. A voltage pulse can be applied to the electrode, providing initial kinetic energy to an ion packet consisting of various m/z values. Ions separate in space according to their velocity and their response to viscous forces as they traverse flow region 270G. In this way, separation on the basis of m/z or molecular structure is possible.

Figure 3:
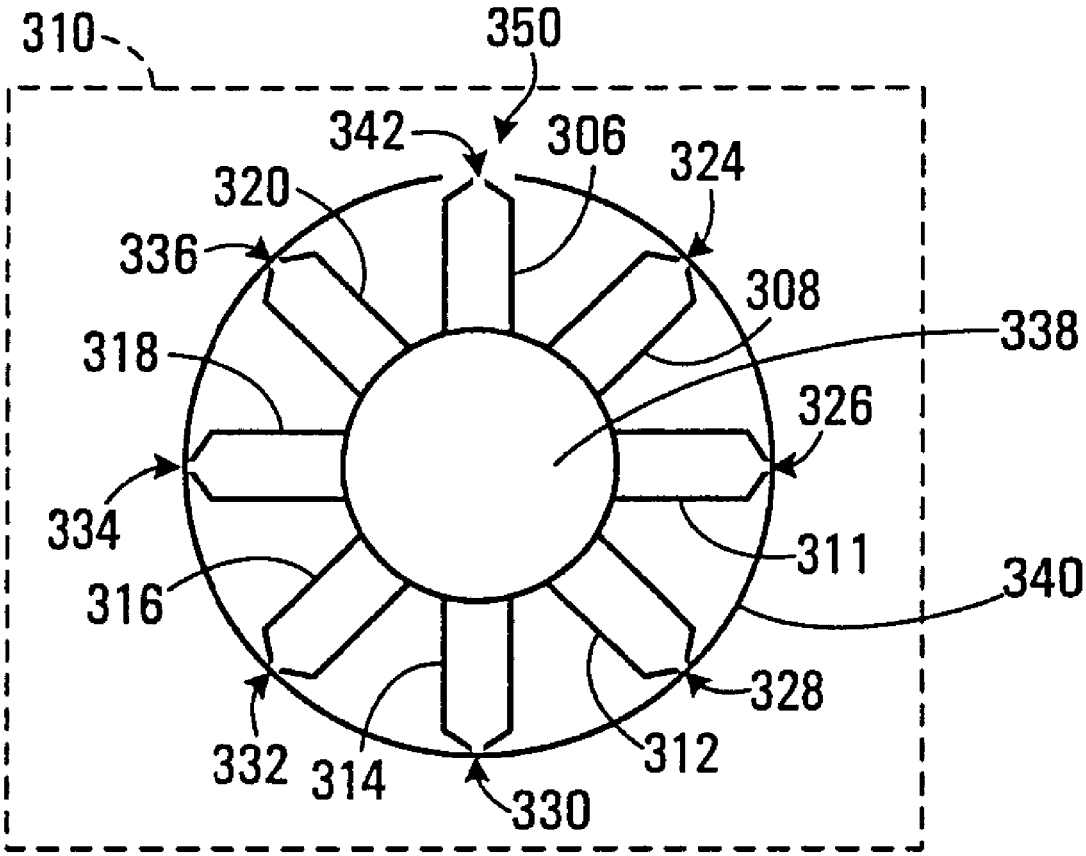
FIG. 3 is a sectional view of an alternative multiple-inlet interface in which multiple ion sources can be applied simultaneously or nearly simultaneously.

It will be apparent to those skilled in the art that a suitable interface could include multiple ion inlets. For example, FIG. 3 displays a possible cross-sectional view of the mass spectrometer interface 310 (or 210A-210G) with multiple sampling channels 306, 308, 310, 312, 314, 316, 318, 320 attached to body 338. Sampling channels 306, 308, 310, 312, 314, 316, 318, 320 include sampling orifices 342, 324, 326, 328, 330, 332, 334, 336 that may be open or blocked at any particular time, suitable for high throughput applications. One or multiple ion sources may be configured in front of sampling orifices 342, 324, 326, 328, 330, 332, 334, 336. In this example, a blocking ring 340 has one or more openings 350 to transmit ions through sampling orifices 342, 324, 326, 328, 330, 332, 334, 336. This potentially increases the number of experiments and ion sources that can be performed per time interval, providing a high throughput advantage.

Referring back to FIG. 1 and FIGS. 2A-2G, in another embodiment, at least one region of the mass spectrometer interface 10 (or 210A-210G) may be configured as a chemical reactor. Chemical reagents or sample analytes are generated by either ESI, APCI or any other ion source, and are mixed with either neutral molecules or ions in the reaction zone prior to sampling. Often it is preferable for this region to be near or within a region of disturbance, although for some cases, such as generating or reacting extremely labile molecular ions, it may be preferable to position the reaction region downstream or upstream of a region of disturbance. Varying the flow tube diameter and length, the temperature, and the reactant concentration controls the reaction time. The gas flow itself can be used as a vehicle to entrain other processes.

Accordingly, a chemical reaction region whereby chemical reagents can be combined to produce alternative ion species, for example to generate one kind of ion, and to discriminate against the rest, may be included along the path of the gas and ions in interface 10 (or 210A-210G). There have been several attempts to discriminate within the ionization process in order to selectively produce certain ions and not others. For example, as disclosed in U.S. Pat. No. 6,124,675 of Bertrand et al., a metastable atom bombardment source is capable of selective ionization. Here, the source consists of metastable rare gas atoms that collide with neutral molecules, and due to an energy transfer mechanism between the excited states of one or both, selective ionization can occur. In many cases there is substantially reduced complexity of a mixture over electron impact sources. The ionization is selective because the neutral molecule must have an ionization potential below that of the rare gas metastable. As another example, there are several cases where charge reduction may be desirable. Peptides and proteins carry many charged sites, and intensity for each m/z value can be very small. It may be desirable to collapse the distribution in some cases to improve the SNR. This can be done through some form of charge stripping (R. G. Kingston, M. Guilhaus, A. G. Brenton, J. H. Beynon, OMS 20 486 (1985)) through anion-ion reactions in a trap (W. J. Herron, D. E. Goerringer, and S. A. McLuckey, RCMS 10 277 (1996)), or through ion-molecule reactions. Alternatively, it may be desirable to squeeze the charge distribution among a number of larger charge states. As yet another example, low energy electron collisions with multiply charge peptides and proteins are now well known to yield useful, alternative fragmentation patterns over conventional fragmentation techniques (Zubarev R. A.; Kelleher, N. L.; McLafferty, F. W J. Am. Chem. Soc. 1998, 120, 3265-3266). It is possible to incorporate similar reactions in the present invention.

In addition to introducing a chemical reagent, or introducing a second mixture of ionized particles as described above, it is also possible to introduce electrons directly into an electron interaction region of the ion source interface 10 to promote interaction between the introduced electrons and the ionized particles. The electron interaction region could be placed at the same locations as the chemical reaction region. A suitable electron source, such as an electron gun or a needle with an applied high voltage, may be used to discharge free electrons and electrons weakly bound to neutral molecules.

Figure 4:
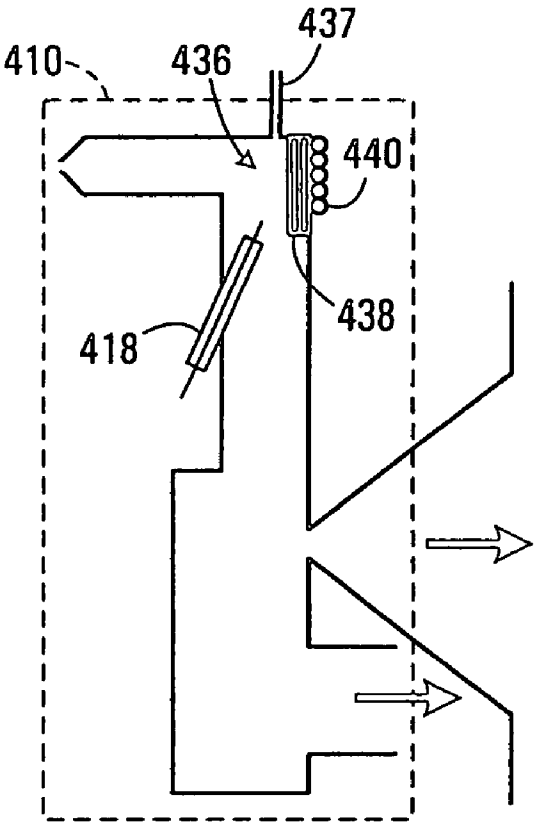
FIG. 4 is a sectional view of an alternative ion source interface in which chemical reactions are induced in the laminar flow region.

Turning to FIG. 4, region 436 of mass spectrometer interface 410 is configured as a chemical reaction chamber. In the depicted embodiment, region 436 is positioned within a region of disturbance. However for some cases, such as generating or reacting extremely labile molecular ions, the reaction region may be positioned downstream or upstream of a region of disturbance. Thermal energy may be applied in this region via heater element 440 applied to a surface 438 that may or may not be a different body from that of the tube itself. Chemical reactants are introduced through chemical introduction of a reagent into opening 437. Molecular ions generated by an ion source react and mix with the reactant gas advantageously near or within region 436, permitting selective removal of some charged species and/or selective enhancement of other charged species. The residence time, pressure, and flow velocity is adjusted by selecting the appropriate sampling orifice, channel and flow tube geometry, and pump speed in the evacuation stage. In some cases it is preferable to incorporate an ion source 418, such as a corona discharge source or electron source, in order to generate atomic or molecular ions or electrons as a source or for advantageous use of chemical reaction of molecules or ions.

It will be apparent to those skilled in the art that multiple ion sources may be applied either simultaneously or in a near-simultaneous but sequential fashion. Multiple ion sources may be applied at atmosphere pressure simultaneous or nearly simultaneous with each other as well as with multiple ion sources positioned in the flow tube. As an example, near simultaneous application of APCI and ESI is often useful, because each technique provides different ionization efficiencies for various classes of compounds that may both be present in a sample. Also, near simultaneous application of MALDI and ESI is sometimes useful, because together they provide more information than either technique alone. This is because MALDI is known to generate primarily singly charged ions while ESI efficiently generates multiply charged ions, for example for peptides and proteins.

Figure 5:
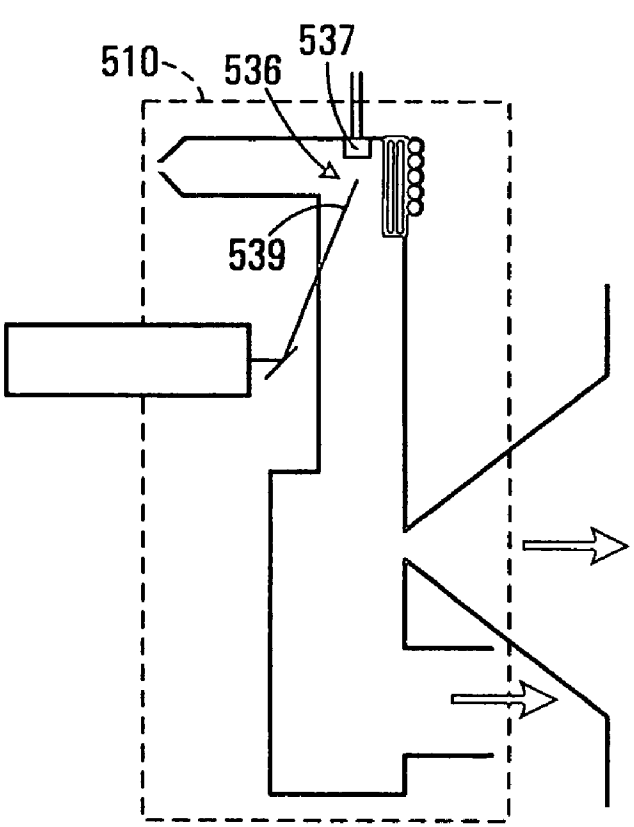
FIG. 5 is a sectional view of an alternative ion source such as MALDI interface is placed near a region of disturbance.

It will also be apparent to those skilled in the art that other ion sources may be advantageously positioned in or near the region of disturbance. For example, as shown in FIG. 5, in an alternative embodiment, a MALDI plate 537 and laser or light source 539 may be positioned near the region of disturbance 536, and gas flow may be used to entrain the MALDI plume for ion sampling. For some cases, such as generating or reacting extremely labile molecular ions, it may be preferable to position the reaction region downstream or upstream of a region of disturbance, respectively. Also, it is sometimes advantageous to position multiple ion sources in the flow tube. For example, corona discharge and MALDI may both be positioned in the flow tube. This is useful for generating ion-ion reactions, for example.

In order to verify that the mass spectrometer interface of the present invention operates to improve signal-to-noise ratio as intended, experiments were conducted.

Figure 6:
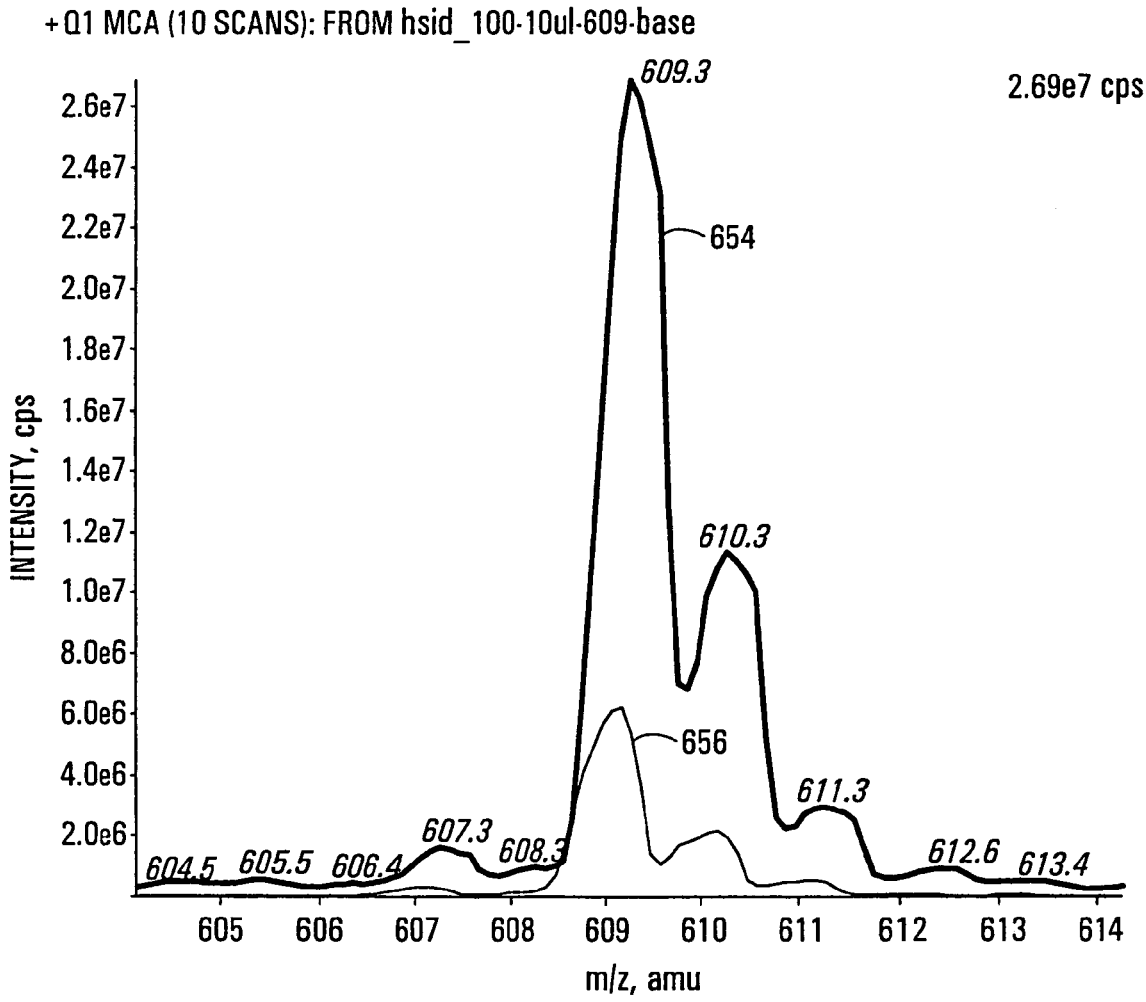
FIG. 6 is an x-y graph showing a sensitivity gain achieved from the application of heat.

In one experiment, data were acquired using a design based on the mass spectrometer interface of FIG. 2D and an atmospheric-pressure electrospray source. A region of disturbance of the mass spectrometer interface was directly heated to 300 C using two embedded cartridge heater elements that deliver up to 150 W. In one series of experiments, data were acquired at a variety of flow rates, from 10 ul/min to 3000 ul/min. By practicing the teachings of the present invention, up to a ten-fold increase in signal-to-noise ratio was observed over more conventional designs at similar flow rates. The advantage of heat was demonstrated in another experiment, using a 10 ul/min flow of reserpine dissolved in 50:50 acetonitrile: water with 0.1% acetic acid. As shown in FIG. 6, the intensity of the ion signal increased approximately four times as the heat was added, from about 630,000 counts per second (cps) for 10 scans unheated (graph line 656), to 27,000,000 (cps) for 10 scans when heated to 100 C, (graph line 654). At higher flows, for example 1 mL/min, an optimal temperature was found to be approximately 300 C, and the sensitivity gain achieved by application of heat was even more pronounced, by up to a factor of ten in comparison to the sensitivity achieved without the application of heat.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

The invention claimed is:

1. A method of providing ionized particles of a sample to a mass spectrometer, comprising:

introducing a mixture of gas and said ionized particles from a source of high pressure into an inlet of a channel;

expanding said mixture into said channel;

maintaining a pressure in said channel between about 1 and 100 Torr;

slowing said gas within said channel to provide a substantially laminar flow proximate an exit of said channel; and sampling said ionized particles proximate said exit, for analysis in said mass spectrometer.

2. The method of claim 1, wherein said channel provides a tortuous path for said mixture of gas creating a region of disturbance for said gas within said channel.

3. The method of claim 1, wherein said channel has a generally round cross-section proximate said region of disturbance, and flow of said gas becomes generally laminar within a distance equal to about twice said diameter from said region of disturbance.

4. The method of claim 1, wherein said tortuous flow is guided around a barrier within said channel.

5. The method of claim 3, wherein said channel guides said gas around a bend having an angle of at least 20 degrees.

6. The method of claim 4, further comprising colliding said ionized particles and attached impurities with a wall of said channel, so as to promote liberation of at least some of said ionized particles from said impurities.

7. The method of claim 6, further comprising deflecting said ionized particles into said mass spectrometer using at least one electrode.

8. The method of claim 7, wherein said deflecting comprises using at least one electrode upstream of said mass spectrometer to pulse said ionized particles, so as to facilitate separation of at least some of said ionized particles.

9. The method of claim 7, further comprising maintaining a pressure in said channel which is less than atmospheric pressure.

10. The method of claim 9, wherein said gas proximate said exit is at a pressure in the range of 1-10 Torr.

11. The method of claim 9, wherein said gas proximate said exit is in at a pressure in the range of 1-2 Torr.

12. The method of claim 2, further comprising introducing a reagent into said channel proximate said region of disturbance, so as to promote reactions between said reagent and said ionized particles.

13. The method of claim 2, further comprising introducing a second mixture of ionized particles and any attached impurities into said channel proximate said region of disturbance, so as to promote ion-ion reactions between said ionized particles of said first and second mixtures.

14. The method of claim 2, further comprising introducing electrons into said channel proximate said region of disturbance, so as to promote interaction between said electrons and said first mixture of ionized particles and any attached impurities.

15. The method of claim 1, wherein said sampling occurs in a region proximate said exit having a pressure in the range of 1-10 Torr.

16. The method of claim 1, wherein sampling occurs in a region proximate said exit having a pressure in the range of 1-2 Torr.

17. An apparatus for providing ionized particles of a target sample to a mass spectrometer, said ionized particles having characteristic mass to charge (m/z) ratios, said apparatus comprising: a channel for guiding a flow of gas from an inlet to an outlet; said channel including a plurality of channel sections having progressively larger cross-sections for slowing said flow of gas, said outlet being provided at a channel section in which flow of said gas has been slowed to be generally laminar to sample ionized particles from said flow generally perpendicular to said flow.

18. The apparatus of claim 17, wherein said exit is in at least the third channel section downstream of said sample inlet.

19. The apparatus of claim 17, wherein said channel has first, second and third sections with progressively larger diameters, said first section having a cross-sectional diameter of between 4-10 mm, said second section having a cross-section diameter of between 5-15 mm, said third section having a cross-section diameter of between 10-30 mm.

20. A method of providing ionized particles of a sample to a mass spectrometer, comprising:

introducing a mixture of gas and said ionized particles from a source of high pressure into a channel;

wherein said channel provides a tortuous path for said mixture of gas creating a region of disturbance for said gas within said channel to aid in liberating at least some of said ionized particles from impurities in said mixture;

slowing said gas within said channel, downstream of said region of disturbance to provide a substantially laminar flow proximate an exit of said channel;

sampling said ionized particles proximate said exit, for analysis in said mass spectrometer; and wherein substantially all of said ionized particles sampled at said exit have passed through said region of disturbance.

21. A method of providing ionized particles of a sample to a mass spectrometer, comprising:

introducing a mixture of gas and said ionized particles from a source of high pressure into a channel;

slowing said gas within said channel to provide a substantially laminar flow proximate a sampling orifice of said channel; and providing an evacuation port downstream of said sampling orifice to maintain a pressure in said channel which is less than atmospheric pressure.

* * * * *